US005856629A

United States Patent [19]

Grosch et al.

[11] Patent Number: 5,856,629

[45] Date of Patent: Jan. 5, 1999

[54] UNMANNED ARMORED MINESWEEPING VEHICLE

[75] Inventors: Hermann Grosch, Nienhagen; Knut Krüger, Weesen; Werner Hasse, Hamburg, all of Germany

[73] Assignee: Rheinmetall Industrie AG, Ratingen, Germany

[21] Appl. No.: 853,721

[22] Filed: May 9, 1997

[30] Foreign Application Priority Data

May 11, 1996 [DE] Germany ..... 19619135.1

[51] Int. Cl.[6] ..... B64D 1/04; B63G 9/00

[52] U.S. Cl. ..... 89/1.13; 102/402

[58] Field of Search ..... 89/1.13, 1.11; 102/402, 403

[56] References Cited

U.S. PATENT DOCUMENTS

| | | | |
|---|---|---|---|
| 2,425,018 | 8/1947 | Williams | 89/1.13 |
| 2,460,322 | 2/1949 | Walker . | |
| 3,837,259 | 9/1974 | Vaughn . | |
| 5,125,317 | 6/1992 | Spektor et al. . | |
| 5,129,323 | 7/1992 | Park | 89/1.11 |
| 5,277,117 | 1/1994 | Bender et al. | 89/1.13 |
| 5,307,272 | 4/1994 | Butler et al. | 102/402 |
| 5,313,868 | 5/1994 | Wolf . | |
| 5,452,639 | 9/1995 | Aulenbacher et al. | 89/1.13 |
| 5,458,063 | 10/1995 | Laine et al. | 89/1.13 |
| 5,712,441 | 1/1998 | Grunewald | 89/1.13 |

FOREIGN PATENT DOCUMENTS

| | | |
|---|---|---|
| 0 574 967 | 12/1993 | European Pat. Off. . |
| 23 30 143 | 1/1975 | Germany . |
| 34 24 231 | 1/1986 | Germany . |
| 38 26 731 | 2/1990 | Germany . |
| 195 12 537 | 2/1996 | Germany . |
| 2 132 567 | 7/1984 | United Kingdom . |
| 2 294 910 | 5/1996 | United Kingdom . |
| 93/15373 | 8/1993 | WIPO . |
| 97/08508 | 3/1997 | WIPO . |

*Primary Examiner*—Charles Jordan
*Assistant Examiner*—Theresa M. Wesson
*Attorney, Agent, or Firm*—Spencer & Frank

[57] ABSTRACT

An unmanned armored minesweeping vehicle includes a vehicle body having a heavily armored vehicle part; a power plant accommodated in the vehicle part for propelling the vehicle; a vehicle steering control accommodated in the vehicle part; and a simulating arrangement for disguising the vehicle as a target for triggering the mines to be cleared.

14 Claims, 3 Drawing Sheets

UNMANNED ARMORED MINESWEEPING VEHICLE

CROSS REFERENCE TO RELATED APPLICATION

This application claims the priority of German Application No. 196 19 135.1 filed May 11, 1996, which is incorporated herein by reference.

BACKGROUND OF THE INVENTION

This invention relates to an unmanned armored minesweeping vehicle, particularly for clearing anti-tank mines.

For sweeping mines a number of various processes are known which, as a rule, are based on the sequential tasks of "searching", "localizing", "marking" and "destroying/clearing". Thus, according to German Offenlegungsschrift (application published without examination) 42 42 541, a mine-contaminated region is searched with an unmanned armored vehicle and the data obtained by sensors are transmitted to a mother vehicle for evaluating and mapping the region.

It is a disadvantage of vehicles of the above-outlined type that, among others, up to the clearing of the mines the entire procedure is extremely time-consuming. Further, long-range mines, that is, mines which may be triggered by a combat vehicle even from a large distance or, in general, externally of its path of travel, cannot be detected and destroyed by conventional minesweepers of the above-outlined type.

German Offenlegungsschrift 34 24 231 discloses a manned special armored vehicle which, for protecting it from mines, carries magnetic coils that generate a characteristic magnetic field for triggering mines that are situated externally of the vehicle outline.

It is a disadvantage of such vehicles that the mines which are equipped with different igniters (detonators) explode and disable the vehicles as they pass over them. Long-range mines too, cannot be detected and destroyed.

German Offenlegungsschrift 38 26 731 discloses a remote-controlled minesweeping vehicle which detonates previously located and marked mines. In such a procedure, the mine is picked up by a tubular body and thereafter detonated so that the fragments may fly only in a vertical direction.

SUMMARY OF THE INVENTION

It is an object of the invention to provide an improved minesweeping vehicle of the above-outlined type with which mines having different igniting systems, including long-range mines, may be cleared in a simple manner.

This object and others to become apparent as the specification progresses, are accomplished by the invention, according to which, briefly stated, the unmanned armored minesweeping vehicle includes a vehicle body having a heavily armored vehicle part; a power plant accommodated in the vehicle part for propelling the vehicle; a vehicle steering control accommodated in the vehicle part; and a simulating arrangement for disguising the vehicle as a target for triggering the mines to be cleared.

Essentially, the invention is based on the principle that minesweeping is performed with a specially constructed minesweeping vehicle which is so designed that the detonators of the mines to be cleared identify the minesweeping vehicle itself as a target. Further, the vehicle is modularized such that the individual structural modules may be rapidly replaced if damaged. Those structural groups which, because of their function, are only modularizable in a limited manner (for example, a diesel engine) and/or are extremely sensitive and thus can be replaced only with significant expense (for example, the electronic systems), are specially protected by appropriate armor to ensure that the exploding mine or a warhead fired at the vehicle by a long-distance mine do not have an appreciable effect.

The minesweeping vehicle according to the invention advantageously permits continuous movements of armored columns by providing that the minesweeping vehicle which has all the characteristics of a target, precedes the vehicle column and triggers the mines. In particular, the traveling path of the minesweeping vehicle may be cleared of mines in a satisfactory manner. Mines with target counters may be triggered by using a plurality of minesweeping vehicles traveling in a single file.

According to an advantageous feature of the invention, the minesweeping vehicle is, for triggering the mines with magnetic igniters, provided with a magnetizable metal arrangement at the underside of the vehicle. In this arrangement at least partial zones of the underside of the vehicle may be pre-magnetized. Further, at the underside of the vehicle additionally magnetic field generators may be arranged for amplifying the target characteristics of the minesweeping vehicle for mines having magnetic igniters.

For triggering mines with infrared or radar igniters it has been found advantageous to provide the unmanned armored minesweeping vehicle with a suitable infrared or radar signature that characterizes combat vehicles. According to an advantageous feature of the invention, to emphasize the infrared signature of the minesweeping vehicle, the surface temperature is increased in the signature-relevant zones. This may be achieved by providing a device which guides the hot exhaust gases of the internal-combustion engine to the upper side and/or to both lateral sides of the minesweeping vehicle.

According to a further feature of the invention, for triggering mines having acoustic detonators, a sound amplifying and/or sound generating device is provided which is coupled with the exhaust system of the minesweeping vehicle and has the acoustic radiation characteristics of a combat vehicle.

For triggering anti-helicopter mines, a device for the acoustic simulation of helicopter sound signals may be mounted on the minesweeping vehicle.

By appropriately shaping the drive wheels of the minesweeping vehicle, the seismic signature of tank tracks may be simulated for triggering, in a simple manner, mines having a seismic detonator.

According to a particularly advantageous feature of the invention, the individual vehicle components have—as far as possible—a grid-like construction to significantly reduce the blast effect of the exploding mines.

According to a further advantageous feature of the invention which was proven to be particularly effective in practice, after triggering a mine by the minesweeping device, the damage configuration is detected by a camera and the image signals are transmitted to a lead vehicle over radio or by cable. With the aid of such an information the damage to the minesweeping vehicle may be determined and, if required, the necessary component replacements may be placed into readiness. Also, from the image of the explosion conclusions may be drawn concerning the type and explosives of the mine.

DESCRIPTION OF THE PREFERRED EMBODIMENT

Figure 1:
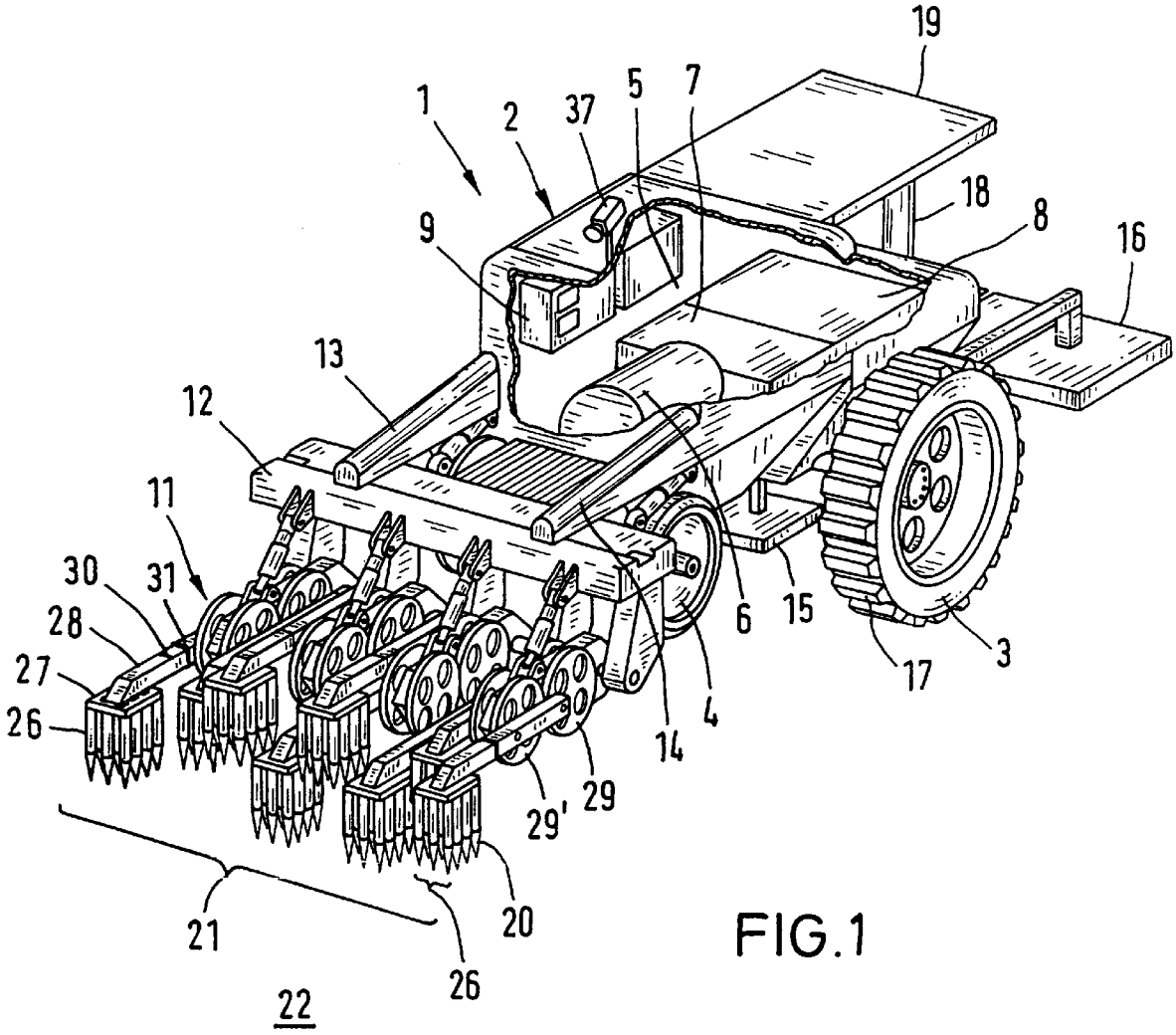
FIG. 1 is a perspective view of an armored minesweeping vehicle according to a preferred embodiment of the invention.

FIG. 1 shows a minesweeping vehicle according to the invention generally designated at 1, composed essentially of a relatively low, heavily armored vehicle part 2 having two drive wheels 3 at the rear and two auxiliary wheels 4 at the front. The inner space of the armored vehicle part 2 accommodates an electric motor 6 for driving the vehicle 1, a current generator 7 for generating current to operate the electric motor 6 and an internal-combustion engine 8 for driving the current generator 7. Such an electric power train may be advantageously designed to be more effective as regards a modular construction, redundancy and mechanical robustness than a mechanical power train as generally used in armored vehicles.

Further, in the space 5 of the armored vehicle part 2 a steering device 9 as well as non-illustrated electronic data processing devices are positioned.

At the front of the minesweeping vehicle 1 an upwardly pivotal walking assembly is disposed which is secured to the vehicle 1 by means of a transverse beam 12 and two cantilever arms 13, 14. The walking assembly 11 will be described in more detail as the specification progresses.

The minesweeping vehicle 1 carries at its underside a magnetic field generator 15, while at its rearward end a sensor 16 is provided for monitoring the vehicle path for not-yet triggered mines.

The configuration 17 of the drive wheels 3 is such that the seismic emission generated thereby corresponds to that of a track laying vehicle.

The exhaust pipe 18 of the internal combustion engine 8 is coupled with a structural element 19 which is provided with particularly shaped apertures in such a manner that the exhaust gases leaving the element 19 in an upward direction simulate an infrared signature characteristic of combat vehicles.

Further, the minesweeping vehicle 1 carries a camera 37 for monitoring the damage configuration after a mine is triggered.

The walking assembly 11 is essentially composed of a plurality of pointed pressure bars 20 which extend along the entire vehicle width 21 and are arranged at such a density that as they pass over and periodically penetrate the soil 22, mines with pressure sensitive detonators are reliably triggered.

Figure 2:
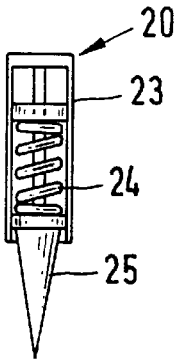
FIG. 2 is an axial sectional view of a pointed pressure bar for triggering pressure-sensitive mine detonators.

Turning to FIG. 2, each individual pointed pressure bar 20 is composed of a hollow cylindrical sleeve 23 open at one end and a spike 25 biased outwardly by a compression spring 24 accommodated in the sleeve 23 behind the spike 25. By virtue of such a construction an approximately uniform pressure exerted by the pressure bars 20 is achieved in case the soil between the body 23 and the spike 25 is not uniform.

Figure 3:
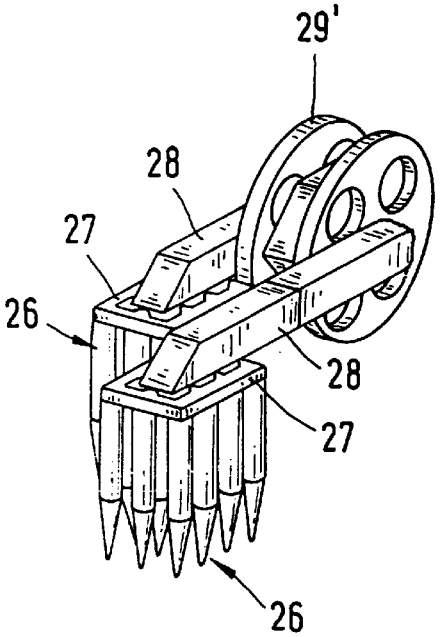
FIG. 3 is a perspective view of two pressure bar groups each coupled by rods to a drive disk according to the invention.

Also referring to FIG. 3, the pressure bars 20 are arranged in pressure bar groups 26 and mounted on a holding plate 27 as shown in FIG. 3. The number of pressure bars 20 in each group 26 is selected such that a pressure-sensitive mine situated in any position underneath a pressure bar group 26 can be exploded reliably by triggering the detonator of the mine.

In the standby (inoperative) position the walking assembly 11 is pivoted into an upward position and is supported by the two frontal auxiliary wheels 4 of the vehicle 1.

For performing the minesweeping operation, the walking assembly 11 is lowered by pivoting it downwardly from its inoperative position, and the frontal auxiliary wheels 4 are pivoted upwardly into an inoperative position. As a result, in its operational state the minesweeping vehicle 1 bears down with its own weight on pairs of pressure bar groups 26 whereby non-uniformities in the soil 22 may be compensated for.

Figure 4:
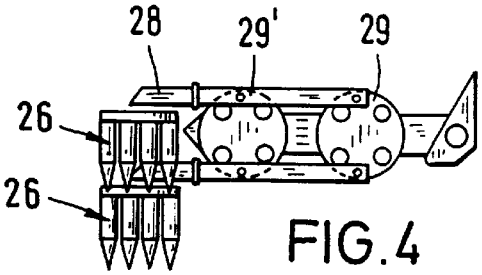
FIGS. 4, 5 and 6 are side elevational views of the construction shown in FIG. 3, illustrating sequential positions.
Figure 5:
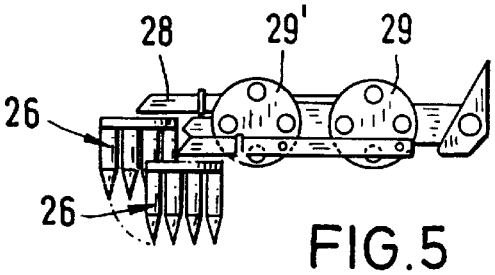
Figure 6:
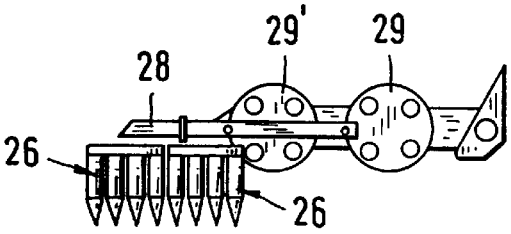

The individual holding devices (holding plates) 27 for each pressure bar group 26 are eccentrically attached by a respective rod 28 to a drive disk 29. The walking assembly 11 is motor driven via the drive disks 29. Simultaneously two holding devices 27 are moved in synchronism in a circular path. In each instance, the four holding devices 27 associated with two pressure bar groups 26 are moved in such a manner that their circular motion is offset 90° as illustrated in the sequential FIGS. 4, 5 and 6. In this manner, at each moment in each instance two pressure bar groups 26 engage the soil 22. The pairing of the pressure bar groups 26 has to be selected such that a sufficient tilt stability of the mine sweeper vehicle 1 is ensured.

As shown in FIG. 1, the rods 28 situated between the holding devices 27 and the drive disks 29 each have a weakened location (intended breakage point) 30 and a rapid disconnecting device (quick release) 31. Upon triggering of a mine, for example, an anti-tank mine, by means of one of the pressure bar groups 26, the pressure bar group 26 ruptures at the weakened location 30 and is destroyed. The free end of the bar 28 is removed by means of the quick release 31 and a new pressure bar group 26 is installed as a replacement.

Figure 7:
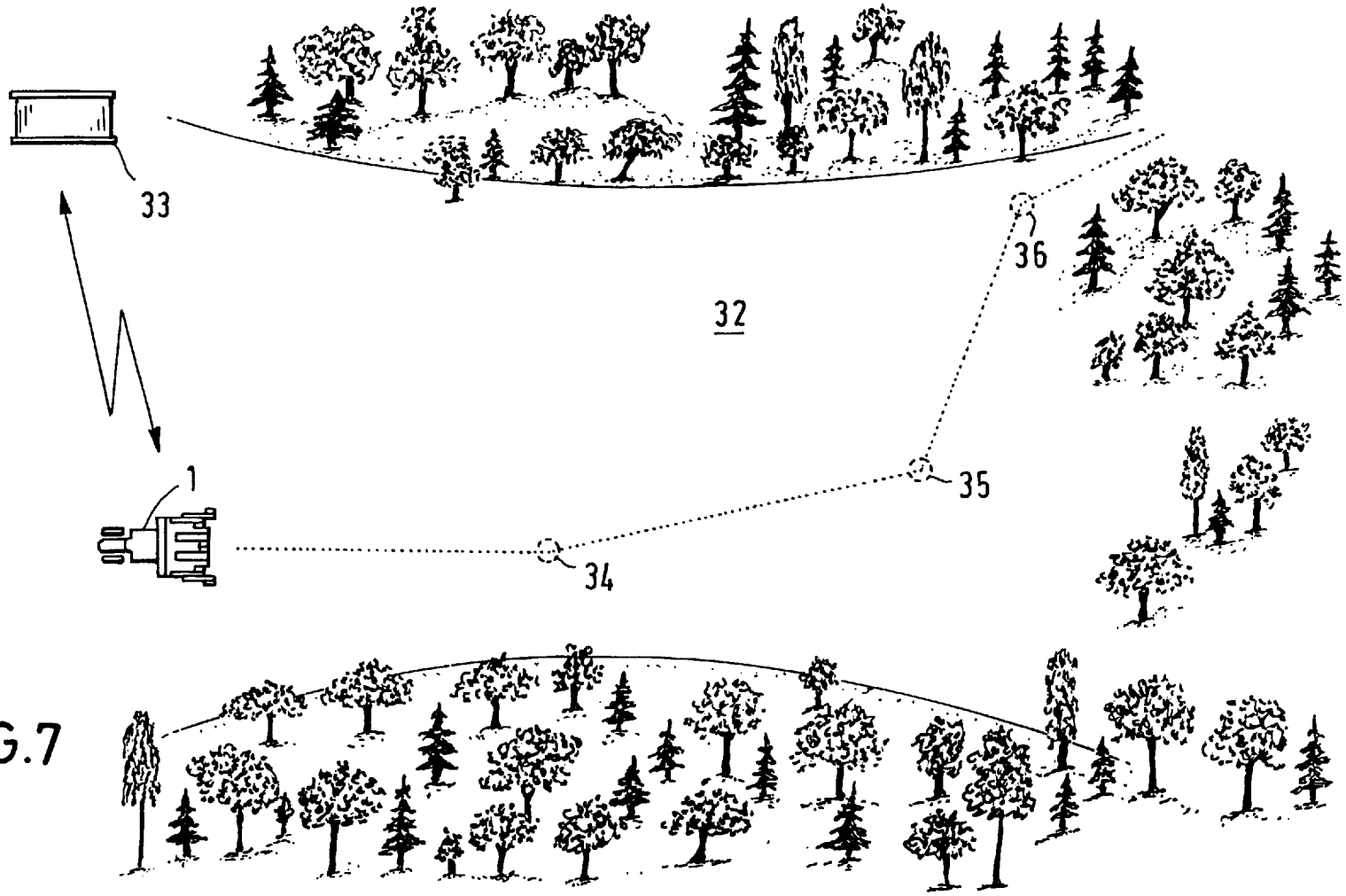
FIG. 7 is a schematic pictorial perspective view showing in operation the minesweeping vehicle according to the invention.

FIG. 7 schematically shows the minesweeping vehicle 1 according to the invention during operation. The area to be cleared of mines is designated at 32. Externally of the area 32 a manned lead vehicle 33 is located which communicates by radio with the minesweeping vehicle 1. The latter may be either remote-controlled or may follow a pre-programmed path by means of an independent navigational device. In the latter case, the minesweeping vehicle 1 follows sequentially the navigational points 34–36 and determines its new course at those points.

It will be understood that the above description of the present invention is susceptible to various modifications, changes and adaptations, and the same are intended to be comprehended within the meaning and range of equivalents of the appended claims.

What is claimed is:

1. An unmanned armored minesweeping vehicle comprising (a) a vehicle body including a heavily armored vehicle part;

(b) a power plant accommodated in said vehicle part for propelling the vehicle; said power plant including an exhaust system;

(c) a vehicle steering control accommodated in said vehicle part; and (d) simulating means for disguising said vehicle body as a target for triggering the mines to be cleared; said simulating means comprising one of sound-amplifying means and sound-forming means coupled with said exhaust system for emitting acoustic waves simulating acoustic waves emitted by a combat vehicle for triggering mines having acoustic igniters.

2. An unmanned armored minesweeping vehicle comprising (a) a vehicle body including a heavily armored vehicle part;

(b) a power plant accommodated in said vehicle part for propelling the vehicle;

(c) a vehicle steering control accommodated in said vehicle part; and (d) simulating means for disguising said vehicle body as a target for triggering the mines to be cleared; said simulating means comprising drive means for generating a seismic signature of tank tracks for triggering mines having seismic igniters.

3. The unmanned armored minesweeping vehicle as defined in claim 2, comprising an underside carrying a magnetic field generator for triggering mines having magnetic igniters.

4. The unmanned armored minesweeping vehicle as defined in claim 2, further comprising means for emitting acoustic waves simulating acoustic waves emitted by helicopters for triggering anti-helicopter mines.

5. The unmanned armored minesweeping vehicle as defined in claim 2, further comprising a sensor disposed at a rear portion of the vehicle for monitoring a travel path of the vehicle for untriggered mines.

6. The unmanned armored minesweeping vehicle as defined in claim 2, further comprising a camera for monitoring damage configurations after triggering a mine.

7. The unmanned armored minesweeping vehicle as defined in claim 2, comprising an underside carrying a magnetizable metal structure for triggering mines having magnetic igniters.

8. The unmanned armored minesweeping vehicle as defined in claim 7, wherein said metal structure is at least partially premagnetized.

9. An unmanned armored minesweeping vehicle comprising (a) a vehicle body including a heavily armored vehicle part;

(b) a power plant accommodated in said vehicle part for propelling the vehicle;

(c) a vehicle steering control accommodated in said vehicle part; and (d) simulating means for disguising said vehicle body as a target for triggering the mines to be cleared; said simulating means comprising drive wheels configured such that the drive wheels upon travel generate a seismic signature of tank tracks for triggering mines having seismic igniters.

10. An unmanned armored minesweeping vehicle comprising (a) a vehicle body including a heavily armored vehicle part;

(b) a power plant accommodated in said vehicle part for propelling the vehicle;

(c) a vehicle steering control accommodated in said vehicle part; and (d) simulating means for disguising said vehicle body as a target for triggering the mines to be cleared; said simulating means comprising means for generating one of an infrared signature and a radar signature for the vehicle for triggering mines having one of an infrared igniter and a radar igniter; said means for generating an infrared signature comprising means for increasing a surface temperature; said means for increasing a surface temperature including an apparatus for directing hot exhaust gases of said power plant to one of an upper face and side faces of the vehicle.

11. An unmanned armored minesweeping vehicle comprising (a) a vehicle body including a heavily armored vehicle part;

(b) a power plant accommodated in said vehicle part for propelling the vehicle;

(c) a vehicle steering control accommodated in said vehicle part; and (d) simulating means for disguising said vehicle body as a target for triggering the mines to be cleared; said simulating means comprising a mechanical pressing system for triggering mines having pressure-responsive igniters; said mechanical pressing system including a plurality of pointed pressure bars extending over an entire width of the vehicle; and said pressure bars being spaced from one another such that mines over which the vehicle passes are triggered; each said pointed pressure bar comprising (1) a cylindrical sleeve having an open axial end;

(2) a spike axially slidably received in said cylindrical sleeve and projecting with a pointed end from said open axial end; and (3) a compression spring disposed in said cylindrical sleeve for resiliently urging said spike outwardly of said open axial end.

12. An unmanned armored minesweeping vehicle comprising (a) a vehicle body including a heavily armored vehicle part;

(b) a power plant accommodated in said vehicle part for propelling the vehicle;

(c) a vehicle steering control accommodated in said vehicle part; and (d) simulating means for disguising said vehicle body as a target for triggering the mines to be cleared; said simulating means comprising a mechanical pressing system for triggering mines having pressure-responsive igniters; said mechanical pressing system including a plurality of pointed pressure bars extending over an entire width of the vehicle; said pressure bars being spaced from one another such that mines over which the vehicle passes are triggered; and said mechanical pressing system including a walking assembly; said walking assembly including (1) a separate holding device each supporting a separate said group;

(2) a separate drive disk;

(3) a separate connecting rod each having a first end attached to a separate said holding device and a second end eccentrically attached to a separate drive disk;

(4) means for driving said drive disks for periodically raising and lowering said groups such that at any time the pointed pressure bars of at least two of said groups engage the ground; and (5) means for connecting said drive disks to a front of said vehicle body;

(e) first securing means for vertically pivotally attaching said walking assembly to said vehicle body at a front thereof for placing said walking assembly in a downwardly-pivoted, operative position and in an upwardly-pivoted, inoperative position;

(f) auxiliary wheels; and (g) second securing means for raisably and lowerably attaching said auxiliary wheels to said vehicle body; whereby in a lowered, operative position of said auxiliary wheels and in an upwardly-pivoted, inoperative position of said walking assembly, said auxiliary wheels support said vehicle body, and in a raised, inoperative position of said auxiliary wheels and in a downwardly-pivoted, operative position of said walking assembly, a weight of said vehicle body bears down on said walking assembly.

13. The unmanned armored minesweeping vehicle as defined in claim 12, wherein each said connecting rod has a weakened location constituting an intended breakage point.

14. The unmanned armored minesweeping vehicle as defined in claim 12, further comprising wheels mounted on the vehicle body for advancing the vehicle; said power plant comprising an electric motor driving said wheels and said walking assembly; a generator supplying said electric motor with electric energy and an internal-combustion engine driving said generator.

* * * * *